US007973492B2

(12) United States Patent
Oh

(10) Patent No.: US 7,973,492 B2
(45) Date of Patent: Jul. 5, 2011

(54) POWER SUPPLY FOR PLASMA DISPLAY PANEL, PLASMA DISPLAY DEVICE INCLUDING THE SAME, AND ASSOCIATED METHODS

(75) Inventor: Kwanil Oh, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 459 days.

(21) Appl. No.: 12/232,718

(22) Filed: Sep. 23, 2008

(65) Prior Publication Data

US 2009/0106566 A1 Apr. 23, 2009

(30) Foreign Application Priority Data

Sep. 27, 2007 (KR) ..... 10-2007-0097415

(51) Int. Cl.
*G05F 1/00* (2006.01)

(52) U.S. Cl. ..... 315/291; 315/278; 315/169.4; 345/211; 345/212; 345/70; 348/372; 363/98; 363/109

(58) Field of Classification Search ..... 315/169.1, 315/169.4, 276, 278, 291; 345/60, 70, 210–212; 348/372, E5.127; 361/98, 109, 131–133, 361/97

See application file for complete search history.

(56) References Cited

U.S. PATENT DOCUMENTS

| | | | | |
|---|---|---|---|---|
| 3,573,542 | A | 4/1971 | Mayer et al. | |
| 3,811,124 | A | 5/1974 | Kleen et al. | |
| 4,097,856 | A | 6/1978 | Lamoureux et al. | |
| 5,864,472 | A * | 1/1999 | Peterson | 363/18 |
| 6,617,800 | B2 * | 9/2003 | Onozawa et al. | 315/169.3 |
| 6,690,586 | B2 | 2/2004 | Hosotani et al. | |
| 7,471,047 | B2 * | 12/2008 | Ogawa | 315/169.4 |
| 2008/0136744 | A1 * | 6/2008 | Tomio et al. | 345/60 |
| 2008/0158102 | A1 * | 7/2008 | Han | 345/60 |

FOREIGN PATENT DOCUMENTS

| | | | |
|---|---|---|---|
| GB | 1 317 663 | | 5/1973 |
| JP | 2006-053324 | | 2/2006 |
| KR | 10-2002-0090909 | A | 12/2002 |
| KR | 10 2004-0083186 | A | 10/2004 |
| KR | 10 2005-0041146 | A | 5/2005 |
| KR | 10-2005-0114157 | A | 12/2005 |
| KR | 10-2006-0072587 | A | 6/2006 |
| KR | 10 2007-0049521 | A | 5/2007 |

* cited by examiner

*Primary Examiner* — Haissa Philogene
(74) *Attorney, Agent, or Firm* — Lee & Morse P.C.

(57) ABSTRACT

A power supply of a plasma display device includes a power source unit configured to convert a direct current source into an alternating current source, a transformer including a primary side winding electrically coupled to the power source unit and a secondary side winding having a first winding and a second winding, a sustain power supply electrically coupled to the first winding of the secondary side of the transformer, the sustain power supply configured to output a first voltage to a first voltage output terminal, and an address power supply electrically coupled to the second winding of the secondary side and serially connected to the sustain power supply, the address power supply configured to output a second voltage to a second voltage output terminal.

15 Claims, 5 Drawing Sheets

【FIG. 1】
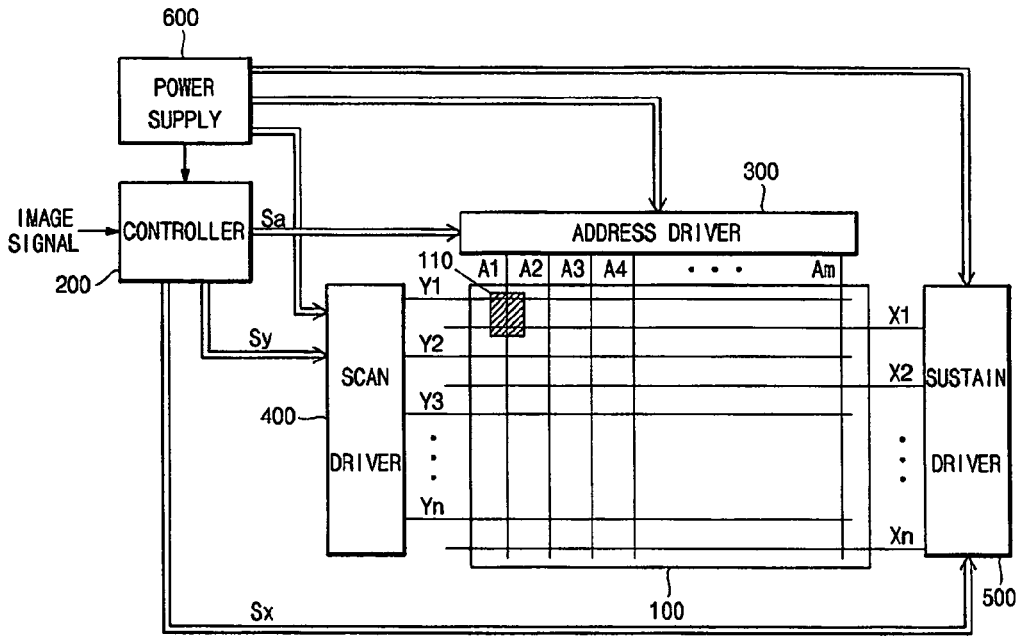

【FIG. 2】
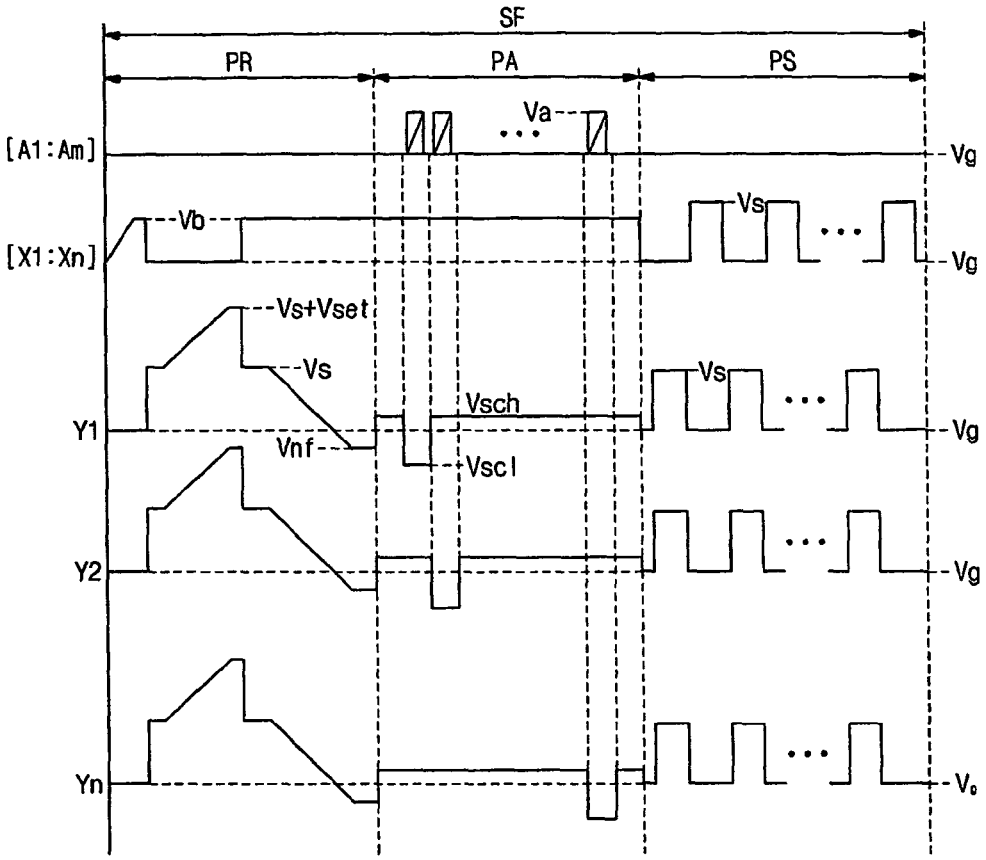

【FIG. 3】
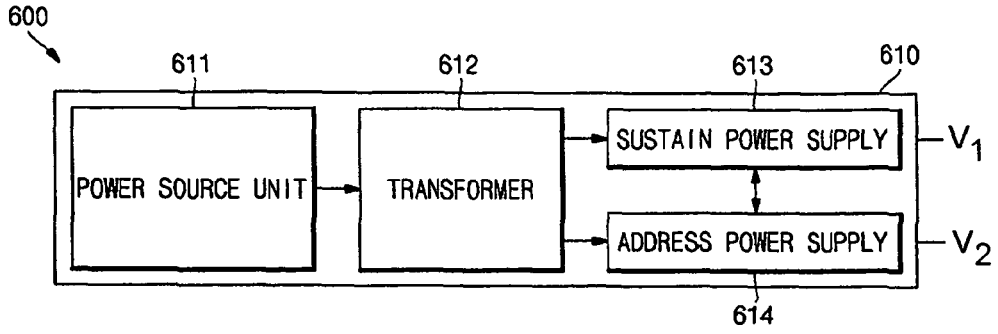
【FIG. 4】
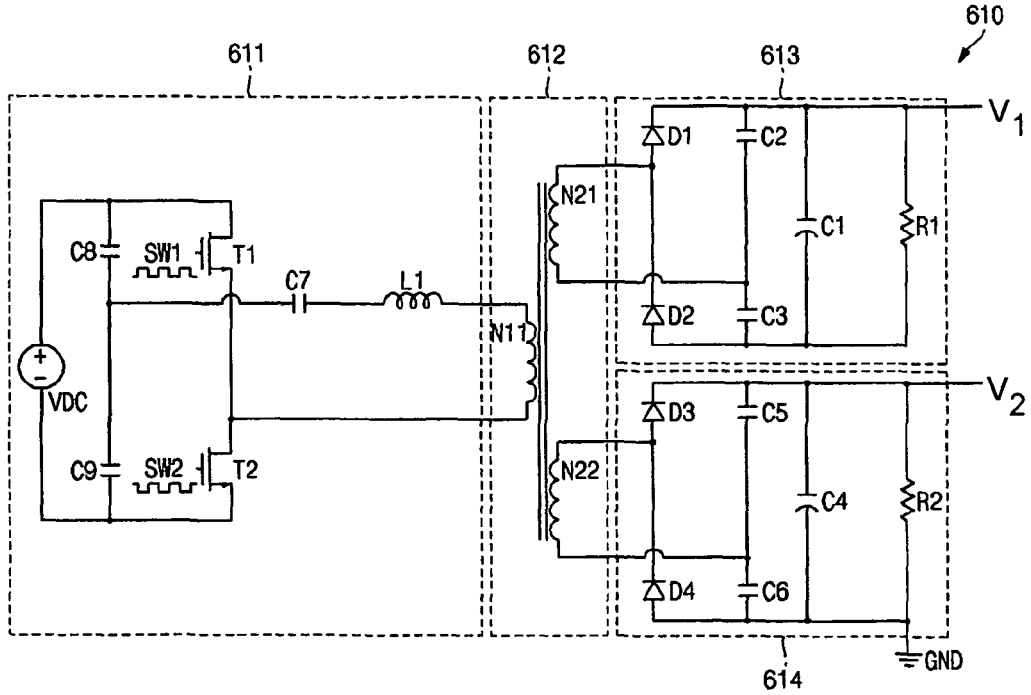

【FIG. 5】
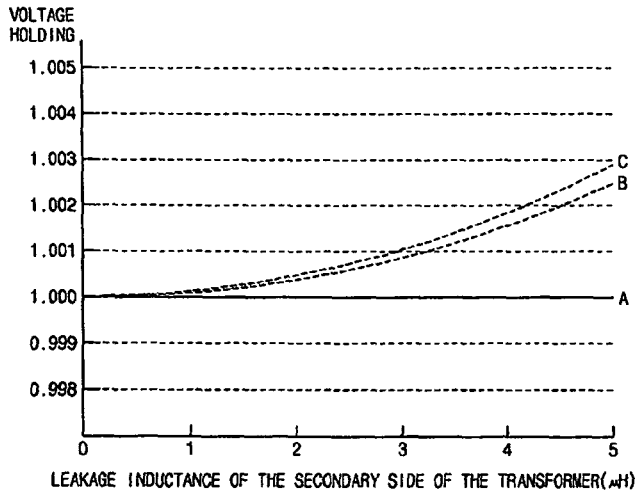
【FIG. 6a】
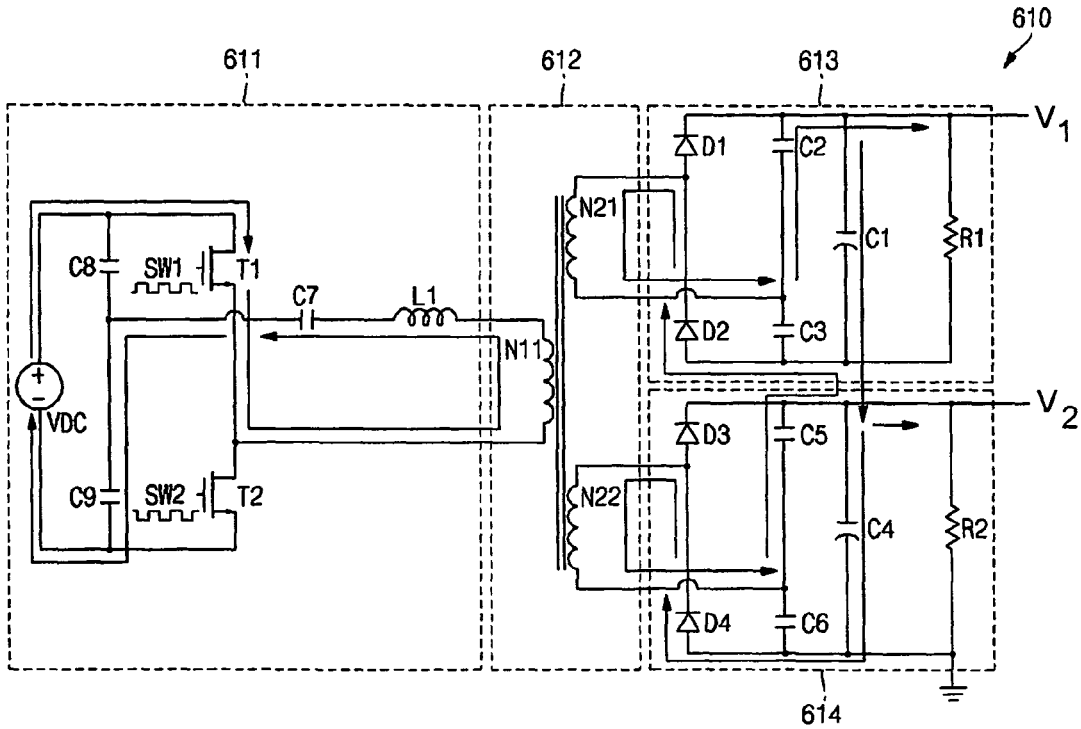

【FIG. 6b】
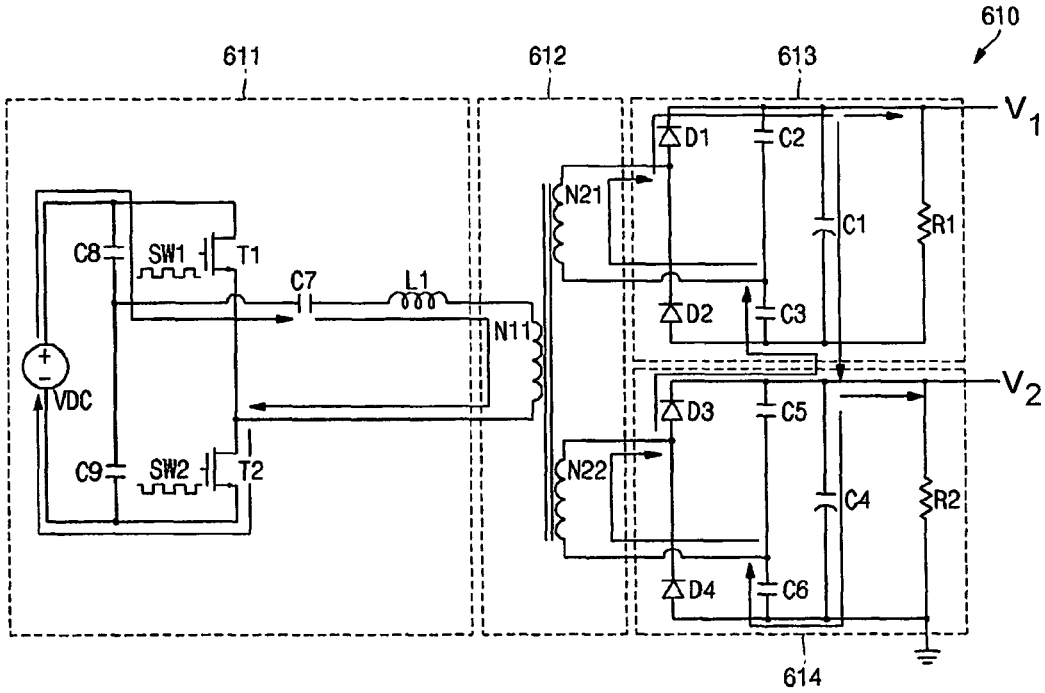

POWER SUPPLY FOR PLASMA DISPLAY PANEL, PLASMA DISPLAY DEVICE INCLUDING THE SAME, AND ASSOCIATED METHODS

BACKGROUND

1. Field of the Invention

Embodiments relate to a power supply for a plasma display panel. More particularly, embodiments relate to a power supply for a plasma display panel, a plasma display device including the same, and associated methods that can improve cross regulation by serially connecting a sustain power supply with to an address power supply.

2. Description of the Related Art

Plasma display panels (PDPs) display images using a gas discharge phenomenon. Generally, PDPs are divided into a direct current (DC) type and an alternating current (AC) type according to a type of driving voltage.

Generally, AC PDPs are three-electrode surface-discharge PDPs. Such PDPs typically include a plurality of pixels formed in regions where a sustain electrode pair and an address electrode cross each other. One pixel includes three (red, green, blue) discharge cells, and a grayscale of an image is expressed by controlling a discharge state of the discharge cell.

Each grayscale can be expressed by dividing one frame into a plurality of subfields in which different numbers of sustain signals are applied. For example, when an image is to be displayed with 256 gray scales, a frame period corresponding to 1/60 second is divided into eight subfields. Each subfield includes a reset period, an address period and a sustain period. The plasma display panel is driven according to each driving cycle.

Power is applied to each power line of the PDP in each driving cycle. Various levels of power supplies are necessary for applying various voltage levels of power to each power line in each driving cycle. A power supply of a general PDP includes power source blocks having a number of transformers corresponding to each output power. However, the power supply of the PDP has a large size and increased production cost due to the multiple transformers.

The power supply may be formed of an integrated circuit (IC) outputting various levels of power voltages. However, in the IC, cross regulation may be increased because of noise interruption by each switch operation when the circuit performs a linkage operation. A post regulator, e.g., a field effect transistor (FET), and a controller IC may be used for improving the cross regulation, but increases size and cost of the power supply.

SUMMARY

Embodiments of the present invention are therefore directed to a power supply for a PDP, a plasma display device including the same, and associated methods, which substantially overcome one or more of the problems due to the limitations and disadvantages of the related art It is therefore a feature of an embodiment of the present invention to provide a power supply for a PDP having a reduced size.

It is therefore another feature of an embodiment of the present invention to provide a power supply for a PDP having a reduced cost.

It is therefore yet another feature of an embodiment of the present invention to provide a power supply for a PDP integrating a sustain power supply outputting a voltage applied to a sustain driver into an address power supply outputting a voltage applied to an address driver.

It is therefore another feature of an embodiment of the present invention to provide is to provide a power supply for a PDP that can improve cross regulation in an integrated circuit integrating a sustain power supply and an address power supply by serially connecting the sustain power supply to the address power supply.

At least one of the above and other features and advantages may be realized by providing a power supply for a plasma display device, which includes a power source unit configured to convert a direct current source into an alternating current source; a transformer including a primary side winding electrically coupled to the power source unit and a secondary side winding having a first winding and a second winding; a sustain power supply electrically coupled to the first winding of the secondary side of the transformer, the sustain power supply configured to output a first voltage to a first voltage output terminal, and an address power supply electrically coupled to the second winding of the secondary side and serially connected to the sustain power supply, the address power supply configured to output a second voltage to a second voltage output terminal.

A current output from the first winding of the secondary side may be circulated to the first winding of the secondary side via the sustain power supply, the address power supply and the secondary winding of the secondary side.

The sustain power supply may include a first diode electrically coupled between a first end of the secondary side first winding and the first voltage output terminal, a second diode electrically coupled between the first diode and the second voltage output terminal, a first capacitor electrically coupled between the first voltage output terminal and the second voltage output terminal, and a first resistor electrically coupled between the first and second voltage output terminals and connected in parallel with the first capacitor.

The sustain power supply may further include a second capacitor electrically coupled between a second end of the secondary side first winding and the first voltage output terminal, and a third capacitor electrically coupled between the second end of the secondary side first winding of the transformer and the second voltage output terminal.

The address power supply may include a third diode electrically coupled between a first end of the secondary side second winding and the second voltage output terminal, a fourth diode electrically coupled between the third diode and a ground, a fourth capacitor electrically coupled between the second voltage output terminal and the ground, and a second resistor electrically coupled between the second voltage output terminal and the ground and connected in parallel with the fourth capacitor.

The address power supply may further include a fifth capacitor electrically coupled between a second end of the secondary side second winding and the second voltage output terminal, and a sixth capacitor electrically coupled between the second end of the secondary side second winding and the ground.

The power source unit may include a first inductor serially connected to one end of the primary side winding of the transformer, a seventh capacitor serially and electrically coupled to the first inductor, a first transistor electrically coupled to the other end of the primary side winding of the transformer, a second transistor electrically coupled to the other end of the primary side winding of the transformer, and a direct current power source electrically coupled between the first and second transistors.

The power source unit may include an eighth capacitor electrically coupled between the first transistor and the seventh capacitor, and a ninth capacitor electrically coupled between the eighth capacitor and the second transistor.

At least one of the above and other features and advantages may be realized by providing a plasma display device, including a plasma display panel and a power supply configured to supply power to the plasma display panel, the power supply including a power source unit configured to convert a direct current source into an alternating current source, a transformer including a primary side winding electrically coupled to the power source unit and a secondary side winding having a first winding and a second winding, a sustain power supply electrically coupled to the first winding of the secondary side of the transformer, the sustain power supply configured to output a first voltage to a first voltage output terminal, and an address power supply electrically coupled to the second winding of the secondary side and serially connected to the sustain power supply, the address power supply configured to output a second voltage to a second voltage output terminal.

At least one of the above and other features and advantages may be realized by providing a method for supplying power to a plasma display panel, including converting a direct current into an alternating current, providing the alternating current to a primary side winding of a transformer, the transformer including a secondary side winding having a first winding and a second winding, outputting an sustain voltage from a first voltage output terminal of a sustain power supply electrically coupled to the first winding of the secondary side of the transformer, and outputting an address voltage from a second voltage output terminal of an address power supply electrically coupled to the second winding of the secondary side of the transformer, the address power supply being serially connected to the sustain power supply.

BRIEF DESCRIPTION OF THE DRAWINGS

The above and other features and advantages will become more apparent to those of ordinary skill in the art by describing in detail exemplary embodiments with reference to the attached drawings, in which:

FIG. 1 illustrates a schematic block diagram of a plasma display device according to one exemplary embodiment of the present invention;

FIG. 2 illustrates a timing diagram of an example of a drive signal output from each driver of FIG. 1;

FIG. 3 illustrates a schematic block diagram of a power supply of the plasma display device according to one exemplary embodiment;

FIG. 4 illustrates a circuit diagram of the power supply of the plasma display device of FIG. 3;

FIG. 5 illustrates a waveform diagram of a simulation result of cross regulation of the power supply of FIG. 4; and FIGS. 6A and 6B illustrate circuit diagrams of current flow of the power supply of FIG. 4.

DETAILED DESCRIPTION

Korean Patent Application No. 10-2007-0097415, filed on Sep. 27, 2007, in the Korean Intellectual Property Office (KIPO), and entitled: "Power Supply for Plasma Display Panel," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. The matters defined in the description, such as the detailed construction and elements, are nothing but specific details provided to assist those of ordinary skill in the art in a comprehensive understanding of the invention. In the entire description, the same drawing reference numerals are used for the same elements across various figures. Further, a term of "electrically coupled" means not only "directly coupled" but also "coupled via other interposing element."

FIG. 1 illustrates a schematic block diagram of the plasma display device. Referring to FIG. 1, the plasma display device may include a PDP 100, a controller 200, an address driver 300, a scan driver 400, a sustain driver 500, and a power supply 600.

The PDP 100 may include a plurality of address electrodes (A1 to Am) arranged in a column direction, and a plurality of sustain electrodes (X1 to Xn) and a plurality of scan electrodes (Y1 to Yn) arranged in a row direction so as to form pairs with each other. Each sustain electrode (X1 to Xn) may correspond to each scan electrode (Y1 to Yn). Generally, one end of each sustain electrode is commonly connected to each other. The PDP 100 may include a first substrate (not shown), on which the sustain electrodes (X1 to Xn) and scan electrodes (Y1 to Yn) are arranged, and a second substrate (not shown) on which the address electrodes (A1 to Am) are arranged. The two substrates may face to each other with an interposing discharge space therebetween and may be arranged so that the scan electrodes (Y1 to Yn) and the sustain electrodes (X1 to Xn) cross the address electrodes (A1 to Am). A discharge space at the intersection of the address electrode (A1 to Am) with the sustain electrode (X1 to Xn) and the scan electrode (Y1 to Yn) forms a discharge cell 110. Such a structure of the PDP 100 is merely an example, and the power supply described below may be applied a PDP having various structures.

The controller 200 may receive image signals from an external device and may output an address drive control signal Sa, a sustain drive control signal Sx, and a scan drive control signal Sy. The controller 200 may divide one frame into a plurality of subfields. Each subfield may be temporally divided to include a reset period, an address period, and a sustain period. Alternatively, the controller 200 may include an image processor processing the input image signal and a logic operation unit for driving the PDP 100 in cooperation with the image processor.

The address driver 300 may receive the address drive control signal Sa from the controller 200 and may apply a display data signal for selecting a discharge cell 110 to each address electrode. The scan driver 400 may receive the scan drive control signal Sy from the controller 200 and may apply a drive voltage to the scan electrodes (Y). The sustain driver 500 may receive the sustain drive control signal Sx from the controller 200 and may apply a drive voltage to the sustain electrodes (X).

The power supply 600 may supply power to the controller 200 and each driver (300, 400, 500) for driving the plasma display device. The power supply 600 may provide a plurality of output voltages supplied to the address driver 300 and scan driver 400 using one transformer.

FIG. 2 illustrates a timing diagram of an example of a drive signal output from each driver of FIG. 1. Referring to FIG. 2, a single frame for driving the PDP 100 may be divided into a plurality of subfields. Each subfield may be subdivided into a reset period (PR), an address period (PA), and a sustain period (PS).

In the reset period (PR), a reset pulse including rising and falling pulses may be applied to the Y electrodes (Y1 to Yn) of the scan driver 400 and a bias voltage Vb may be applied to the X electrodes (X1 to Xn) of the sustain driver 500 from the time when the falling pulse is applied, thereby performing a reset discharge. Every discharge cell 110 may be initialized by the reset discharge. The rising pulse may increase from a sustain discharge voltage Vs by a rising voltage Vset, finally reaching a highest rising voltage (Vset+Vs). The falling pulse may decrease from the sustain discharge voltage Vs, finally reaching a lowest falling voltage Vnf.

In the address period (PA), a scan pulse may be sequentially applied to the Y electrodes (Y1 to Yn) of the scan driver 400 and the display data signal may be supplied to the address electrodes (A1 to Am) of the address driver 300 with the scan pulse, thereby performing an address discharge. A discharge cell may be selected by the address discharge, i.e., a sustain discharge may be performed in the discharge cell during the sustain period. When selected, the voltage of the scan pulse may decrease from a scan high voltage Vsch to a scan low voltage Vscl lower than the scan high voltage Vsch. The display data signal may have a positive address voltage Va when the scan low voltage Vscl of the scan pulse is applied to a corresponding Y electrode.

In the sustain period (PS), a sustain pulse may be alternately applied to the X electrodes (X1 to Xn) of the sustain driver 500 and the Y electrodes (Y1 to Yn) of the scan driver 400, thereby performing a sustain discharge. By the sustain discharge, brightness is expressed according to a grayscale weight value assigned to each subfield. The sustain signal may alternately have a discharge voltage Vs and a ground voltage Vg.

In the drive signals as described above, a sustain load and an address load are not simultaneously increased. In other words, when the sustain load is increased, the address load is decreased. In contrast, when the address load is increased, the sustain load is decreased. Therefore, in accordance with embodiments, a sustain power supply and an address power supply may be serially connected to each other and share one transformer. Thus, cost and size of a power generating block may be reduced by using two serially connected power supplies.

The drive signal output from each driver of FIG. 1 may be different from that as shown in FIG. 2, and is not limited thereto.

FIG. 3 illustrates a schematic block diagram of a power supply of the plasma display device according to one exemplary embodiment.

Referring to FIG. 3, in the power supply 600, a power supplying unit 610 providing a plurality of output voltages supplied to the address driver 300 and sustain driver 500 will be explained in detail. The power supplying unit 610 of the power supply 600 may include a power source unit 611, a transformer 612, a sustain power supply 613, and an address power supply 614. The power supplying unit 610 of the power supply 600 may improve cross regulation by serially connecting the sustain power supply 613 to the address power supply 614.

The power source unit 611 may receive DC power and convert DC power into AC power. The power source unit 611 may then apply the AC power to the transformer 612.

The transformer 612 may be electrically coupled to the power source unit 611, the sustain power supply 613, and address power supply 614. The transformer 612 may transmit a current corresponding to the AC power applied from the power source unit 611 to the sustain power supply 613 and address power supply 614.

The sustain power supply 613 may output a voltage corresponding to the current applied from the transformer 612 to a first voltage output terminal V1. The first voltage output terminal V1 may be electrically coupled to the sustain driver 500 (FIG. 1) so as to transmit the sustain drive voltage Vs, i.e., the first voltage, to the sustain driver 500 (FIG. 1).

The address power supply 614 may output a voltage corresponding to the current applied from the transformer 612 to a second voltage output terminal V2. The second voltage output terminal V2 may be electrically coupled to the address driver 300 (FIG. 1) so as to transmit the address drive voltage Va, i.e., the second voltage, to the address driver 300 (FIG. 1).

FIG. 4 illustrates a circuit diagram of the power supplying unit 610 of the power supply 600 of FIG. 3. Referring to FIG. 4, the power supplying unit 610 of the power supply 600 may include the power source unit 611, the transformer 612, the sustain power supply 613 and the address power supply 614.

In particular, the power source unit 611 may include a DC power source VDC, a first transistor T1, a second transistor T2, a first inductor L1, a seventh capacitor C7, an eighth capacitor C8, and a ninth capacitor C9.

A first electrode of the DC power source VDC may be electrically coupled to a first electrode of the eighth capacitor C8 and a first electrode (drain or source) of the first transistor T1. A second electrode of the DC power source VDC may be electrically coupled to a second electrode of the ninth capacitor C9 and a second electrode (drain or source) of the second transistor T2. The DC power source VDC may apply a DC voltage to a first electrode of the eighth capacitor C8 and the first transistor T1. In an implementation (not shown), the DC power source VDC may generate DC power by receiving AC power from an AC current power source, rectifying the AC power through a rectifier, and correcting its power factor through a power factor correction circuit. The AC power source, the rectifier, and the power factor correction circuit may be included in the direct current power source VDC.

The first electrode of the first transistor T1 may be electrically coupled between the first electrode of the DC power source VDC and the eighth capacitor C8. The second electrode of the first transistor T1 may be electrically coupled to a first electrode of the second transistor T2 and a primary side winding N11 of the transformer 612. The second electrode of the second transistor T2 may be electrically coupled between the second electrode of the ninth capacitor C9 and the second electrode of the DC power source VDC. First and second switching signals SW1 and SW2 having alternating phases may be respectively applied to control electrodes of the first transistor T1 and the second transistor T2. The first transistor T1 may be switched according to the first switching signal SW1 and the second transistor T2 may be switched according to the second switching signal SW2, thereby allowing the first transistor T1 and second transistor T2 to be alternately turned on.

A first electrode of the first inductor L1 may be electrically coupled to a second electrode of the seventh capacitor C7. A second electrode of the first inductor L1 may be electrically coupled to one end of the primary side winding N11 of the transformer 612.

A first electrode of the seventh capacitor C7 may be electrically coupled between the eighth capacitor C8 and ninth capacitor C9, and a second electrode of the seventh capacitor C7 may be electrically coupled to the first electrode of the first inductor L1. The first electrode of the eighth capacitor C8 may be electrically coupled between the first electrode of the first transistor T1 and the first electrode of the DC power source VDC, and a second electrode of the eighth capacitor C8 may be electrically coupled between the seventh capacitor C7 and ninth capacitor C9. A first electrode of the ninth capacitor C9 may be electrically coupled between the seventh capacitor C7 and eighth capacitor C8. The second electrode of the ninth capacitor C9 may be electrically coupled between the second electrode of the second transistor T2 and the second electrode of the DC power source VDC.

When the first transistor T1 is turned on, current is circulated through the first transistor T1, the transformer 612, the first inductor L1 and the capacitors C7 and C8 to the DC power source VDC from the DC power source VDC. When the second transistor T2 is turned on, current is circulated through the capacitors C7 and C8, the first inductor L1 and the transformer 612 to the DC power source VDC from the DC power source VDC. In this time, LC resonance is generated by the first inductor L1 electrically coupled to the primary side winding N11 of the transformer 612 and the capacitors C7, C8 and C9.

The primary side winding N11 of the transformer 612 may be electrically coupled to the power source unit 611, a secondary side first winding N21 may be electrically coupled to the sustain power supply 613, and a secondary side second winding N22 may be electrically coupled to the address power supply 614. When a voltage corresponding to the DC power source VDC is applied to the primary side winding N11, a voltage proportional to a ratio of a number of windings of the primary side winding N11 and the secondary side windings N21 and N22 is induced to both ends of the secondary side first winding N21 and secondary side second winding N22. If the ratio of the number of windings of the primary side winding N11 and the secondary side second winding N22 are the same, the voltages induced to the secondary side first winding N21 and secondary side second winding N22 are also the same.

The sustain power supply 613 may include a first diode D1, a second diode D2, a first capacitor C1, a second capacitor C2, a third capacitor C3, and a first resistor R1. An anode of the first diode D1 may be electrically coupled between one end of the secondary side first winding N21 of the transformer 612 and a cathode of the second diode D2. A cathode of the first diode D1 may be electrically coupled between the first capacitor C1 and the second capacitor C2. An anode of the second diode D2 may be electrically coupled between the first capacitor C1 and the second capacitor C2. A cathode of the second diode D2 may be electrically coupled between one end of the secondary side first winding N21 of the transformer 612 and the anode of the first diode D1.

A first electrode of the first capacitor C1 may be electrically coupled between the first voltage output terminal V1 and a first electrode of the second capacitor C2. A second electrode of the first capacitor C1 may be electrically coupled between the second voltage output terminal V2 and a second electrode of the third capacitor C3. A first electrode of the second capacitor C2 may be electrically coupled between the first voltage output terminal Vs and the first electrode of the first capacitor C1. A second electrode of the second capacitor C2 may be electrically coupled between the other end of the secondary side first winding N21 of the transformer 612 and a first electrode of the third capacitor C3. The first electrode of the third capacitor C3 may be electrically coupled between the other end of the secondary side first winding N21 of the transformer 612 and the second electrode of the second capacitor C2. The diodes D1 and D2, and the capacitors C1, C2 and C3 may output a certain magnitude of DC voltage to the first voltage output terminal V1 by rectifying and smoothing the voltage applied from the transformer 612.

A first electrode of the first resistor R1 may be electrically coupled between the first voltage output terminal V1 and the first electrode of the first capacitor C1. A second electrode of the first resistor R1 may be electrically coupled between the first voltage output terminal V1 and a second electrode of the first capacitor C1. That is, the first resistor R1 may be connected in parallel with the first capacitor C1. The first resistor R1 may determine a voltage output to the first voltage output terminal V1 as an output load according to its resistance value.

The address power supply 614 may include a third diode D3, a fourth diode D4, a fourth capacitor C4, a fifth capacitor C5, a sixth capacitor C6, and a second resistor R2. An anode of the third diode D3 may be electrically coupled between one end of the secondary side second winding N22 of the transformer 612. A cathode of the fourth diode D4 and a cathode of the third diode D3 may be electrically coupled between the fourth capacitor C4 and fifth capacitor C5. An anode of the fourth diode D4 may be electrically coupled between the fourth capacitor C4 and sixth capacitor C6. The cathode of the fourth diode D4 may be electrically coupled between one end of the secondary side second winding N22 of the transformer 612 and the anode of the third diode D3.

A first electrode of the fourth capacitor C4 may be electrically coupled between the second voltage output terminal V2 and a first electrode of the fifth capacitor C5. A second electrode of the fourth capacitor C4 may be electrically coupled between a ground GND and a second electrode of the sixth capacitor C6. The first electrode of the fifth capacitor C5 may be electrically coupled between the second voltage output terminal V2 and the first electrode of the fourth capacitor C4. A second electrode of the fifth capacitor C5 may be electrically coupled between the other end of the secondary side second winding N22 of the transformer 612 and the first electrode of the sixth capacitor C6. A first electrode of the sixth capacitor C6 may be electrically coupled between the other end of the secondary side second winding N22 of the transformer 612 and the second electrode of the fifth capacitor C5. The second electrode of the sixth capacitor C6 may be electrically coupled between the ground GND and the second electrode of the fourth capacitor C4. The diodes D3 and D4, and the capacitors C4, C5 and C6 may output a certain magnitude of DC voltage to the second voltage output terminal V2 by rectifying and smoothing the voltage applied from the transformer 612.

A first electrode of the second resistor R2 may be electrically coupled between the second voltage output terminal V2 and the first electrode of the fourth capacitor C4. A second electrode of the second resistor R2 may be electrically coupled between the ground GND and the second electrode of the fourth capacitor C4. That is, the second resistor R2 may be connected in parallel with the fourth capacitor C4. A resistance value of the second resistor R2 may determine a voltage output to the second voltage output terminal V2 as an output load.

The power supply 600 may be an IC outputting the first and second voltages Vs and Va using one transformer 612. When a voltage value of one winding of the transformer 612 is changed, a phenomenon that a voltage of other winding is indirectly changed in correspondence with the changed voltage value, i.e., cross regulation, is generated. Such cross regulation may be improved using a post regulator. However, in accordance with embodiments, cross regulation may be minimized by serially connecting the sustain power supply 613 to the address power supply 614 without using a post regulator. The power supply 600 may use the IC to output the first and second voltages Vs and Va, improving the cross regulation without using the post regulator used in a general IC, thereby reducing the size and production cost of the power supply.

FIG. 5 illustrates a waveform diagram of a simulation result of cross regulation of the power supplying unit 610 of FIG. 4. FIG. 5 illustrates a cross regulation, i.e., a voltage maintaining ratio according to a leakage inductance generated at the secondary side of the transformer 612. That is, if the voltage is maintained at "1" when the leakage inductance is increased, the cross regulation becomes "0". If the voltage is increased or decreased from "1", the cross regulation is increased.

FIG. 5 shows simulation result cross regulation waveforms B and C of the sustain power supply 613 and address power supply 614 electrically coupled to the secondary side windings N21 and N22 of the transformer 612 when a voltage is applied to the primary side winding N11 of the transformer 612 through the power source unit 611. In addition, a reference voltage waveform A is illustrated, where the reference voltage is a voltage when the cross regulation does not occur. Thus, the smaller a difference between the cross regulation waveforms B and C and the reference voltage waveform A indicates less cross regulation. In the power supply 600, a voltage change shown in the cross regulation waveforms B and C of the sustain power supply 613 and address power supply 614 is less than 5%, i.e., within a range required in an actual PDP device. The cross regulation of the power supply 600 within this range does not give rise to defects when used with the PDP device.

FIGS. 6A and 6B illustrate current flows of the power supplying unit 610 of FIG. 4. FIG. 6A illustrates a current flow when the first transistor T1 of the power supply 600 is turned on. FIG. 6B illustrates a current flow when the second transistor T2 of the power supply 600 is turned on.

Referring to FIG. 6A, when the first transistor T1 is turned on, the current of the DC power source VDC is circulated through the first transistor T1, the first inductor L1, the capacitors C7 and C9 from the DC power source VDC. Thus, LC resonance is generated by the first inductor L1 electrically coupled to the primary side winding N11 of the transformer 612 and the capacitors C7 and C9.

The current is transmitted to the first resistor R1 and the first capacitor C1 through the second capacitor C2 electrically coupled to the secondary side first winding N21 of the transformer 612, and to the second resistor R2 and the fourth capacitor C4 through the first capacitor C1. The current is transmitted to the fourth diode D4 through the fourth capacitor C4 and transmitted to the fifth capacitor C5 through the secondary side second winding N22 of the transformer 612. The current is circulated to the secondary side first winding N21 of the transformer 612 through the fifth capacitor C5 and the second diode D2. The diodes D2 and D4, and the capacitors C1, C2, C4 and C5 output a certain magnitude of DC voltage to the first and second voltage output terminals V1 and V2 by rectifying and smoothing the voltage applied from the transformer 612.

Thus, when the transistor T1 is turned on, the sustain power supply 613 electrically coupled to the secondary side first winding N21 and the address power supply 614 electrically coupled to the secondary side second winding N22 are serially connected to each other. Thus, the current is circulated there through, thereby improving the cross regulation between the secondary side first and second windings N21 and N22.

Referring to FIG. 6B, when the second transistor T2 is turned on, the current of the DC power source VDC is circulated through the capacitors C7 and C8, the first inductor L1, the transformer 612 and the second transistor T2 from the DC power source VDC. Thus, LC resonance is generated by the first inductor L1 electrically coupled to the primary side winding N11 of the transformer 612 and the capacitors C7 and C8.

The current is transmitted to the first resistor R1 and the first capacitor C1 through the first diode D1 electrically coupled to the secondary side first winding N21 of the transformer 612, and the current is transmitted to the second resistor R2 and the fourth capacitor C4 through the first capacitor C1. The current is transmitted to the sixth capacitor C6 through the fourth capacitor C4 and transmitted to the third diode D3 through the secondary side second winding N22 of the transformer 612. The current is circulated to the secondary side first winding N21 of the transformer 612 through the third diode D3 and the third capacitor C3. The diodes D1 and D3, and the capacitors C1, C3, C4 and C6 output a certain magnitude of DC voltage to the first and second voltage output terminals V1 and V2 by rectifying and smoothing the voltage applied from the transformer 612.

Thus, when the transistor T2 is turned on, the sustain power supply 613 electrically coupled to the secondary side first winding N21 and the address power supply 614 electrically coupled to the secondary side second winding N22 are serially connected to each other. Thus, the current is circulated to each other, thereby improving the cross regulation between the secondary side first and second windings N21 and N22.

As described above, the power supply of a plasma display device according to embodiments may produce one or more of the following effects.

First, the size and cost of the power supply may be reduced by integrating the sustain power supply outputting the voltage applied to the sustain driver and the address power supply outputting the voltage applied to the address driver.

Second, cross regulation, i.e., the phenomenon of voltage change generated in an IC integrating the sustain power supply and the address power supply, may be improved by serially connecting the sustain power supply to the address power supply.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A power supply for a plasma display panel, comprising:

a power source unit configured to convert a direct current source into an alternating current source;

a transformer including a primary side winding electrically coupled to the power source unit and a secondary side winding having a first winding and a second winding;

a sustain power supply electrically coupled to the first winding of the secondary side, the sustain power supply configured to output a first voltage to a first voltage output terminal; and an address power supply electrically coupled to the second winding of the secondary side of the transformer and serially connected to the sustain power supply the address power supply configured to output a second voltage to a second voltage output terminal.

2. The power supply for a plasma display panel as claimed in claim 1, wherein a current output from the first winding of the secondary side of the transformer is circulated to the first winding of the secondary side through the sustain power supply, the address power supply and the second winding of the secondary side.

3. The power supply for a plasma display panel as claimed in claim 1, wherein the sustain power supply comprises:

a first diode electrically coupled between a first end of the secondary side first winding and the first voltage output terminal;

a second diode electrically coupled between the first diode and the second voltage output terminal;

a first capacitor electrically coupled between the first voltage output terminal and the second voltage output terminal; and a first resistor electrically coupled between the first and second voltage output terminals and connected in parallel with the first capacitor.

4. The power supply for a plasma display panel as claimed in claim 3, wherein the sustain power supply further comprises:

a second capacitor electrically coupled between a second end of the secondary side first winding and the first voltage output terminal; and a third capacitor electrically coupled between the second end of the secondary side first winding rmer and the second voltage output terminal.

5. The power supply for a plasma display panel as claimed in claim 3, wherein the address power supply comprises:

a third diode electrically coupled between a first end of the secondary side second winding and the second voltage output terminal;

a fourth diode electrically coupled between the third diode and a ground;

a fourth capacitor electrically coupled between the second voltage output terminal and the ground; and a second resistor electrically coupled between the second voltage output terminal and the ground and connected in parallel with the fourth capacitor.

6. The power supply for a plasma display panel as claimed in claim 5, wherein the address power supply further comprises:

a fifth capacitor electrically coupled between a second end of the secondary side second winding and the second voltage output terminal; and a sixth capacitor electrically coupled between the second end of the secondary side second winding and the ground.

7. The power supply for a plasma display panel as claimed in claim 1, wherein the power source unit comprises:

a first inductor serially connected to a first end of the primary side winding;

a seventh capacitor serially and electrically coupled to the first inductor;

a first transistor electrically coupled to a second end of the primary side winding;

a second transistor electrically coupled to the second end of the primary side winding, and a direct current power source electrically coupled between the first and second transistors.

8. The power supply for a plasma display panel as claimed in claim 7, wherein the power source unit further comprises:

an eighth capacitor electrically coupled between the first transistor and the seventh capacitor; and a ninth capacitor electrically coupled between the eighth capacitor and the second transistor.

9. The power supply for a plasma display panel as claimed in claim 1, wherein the address power supply further comprises:

a third diode electrically coupled between a first end of the secondary side second winding of the transformer and the second voltage output terminal;

a fourth diode electrically coupled between the third diode and the ground;

a fourth capacitor electrically coupled between the second voltage output terminal and the ground; and a second resistor electrically coupled between the second voltage output terminal and the ground, and connected in parallel with the fourth capacitor.

10. The power supply for a plasma display panel as claimed in claim 9, wherein the address power supply further comprises:

a fifth capacitor electrically coupled between a second end of the secondary side second winding and the second voltage output terminal; and a sixth capacitor electrically coupled between the second end of the secondary side second winding and the ground.

11. The power supply for a plasma display panel as claimed in claim 10, wherein the sustain power supply comprises:

a second capacitor electrically coupled between the other end of the secondary side first winding of the transformer and the first voltage output terminal; and a third capacitor electrically coupled between the other end of the secondary side first winding of the transformer and the second voltage output terminal.

12. A plasma display device, comprising:

a plasma display panel; and a power supply configured to supply power to the plasma display panel, the power supply including:

a power source unit configured to convert a direct current source into an alternating current source;

a transformer including a primary side winding electrically coupled to the power source unit and a secondary side winding having a first winding and a second winding;

a sustain power supply electrically coupled to the first winding of the secondary side, the sustain power supply configured to output a first voltage to a first voltage output terminal; and an address power supply electrically coupled to the second winding of the secondary side of the transformer and serially connected to the sustain power supply the address power supply configured to output a second voltage to a second voltage output terminal.

13. The plasma display device as claimed in claim 12, wherein a current output from the first winding of the secondary side is circulated to the first winding of the secondary side through the sustain power supply, the address power supply and the secondary winding of the secondary side.

14. A method for supplying power to a plasma display panel, comprising:

converting a direct current into an alternating current;

providing the alternating current to a primary side winding of a transformer, the transformer including a secondary side winding having a first winding and a second winding;

outputting a sustain voltage from a first voltage output terminal of a sustain power supply electrically coupled to the first winding of the secondary side of the transformer; and outputting an address voltage from a second voltage output terminal of an address power supply electrically coupled to the second winding of the secondary side of the transformer, the address power supply being serially connected to the sustain power supply.

15. The method as claimed in claim 14, further comprising circulating a current output from the first winding of the secondary side to the first winding of the secondary side of the transformer through the sustain power supply, the address power supply and the secondary winding of the secondary side.

* * * * *